US006511296B2

(12) United States Patent
Ota et al.

(10) Patent No.: US 6,511,296 B2
(45) Date of Patent: Jan. 28, 2003

(54) COMPRESSOR

(75) Inventors: Masaki Ota, Kariya (JP); Tomoji Tarutani, Kariya (JP); Ken Suitou, Kariya (JP); Tomohiro Wakita, Kariya (JP); Yoshinori Inoue, Kariya (JP); Hirotaka Kurakake, Kariya (JP)

(73) Assignee: Kabushiki Kaisha Toyoda Jidoshokki Seisakusho, Kariya (JP)

( * ) Notice: Subject to any disclaimer, the term of this patent is extended or adjusted under 35 U.S.C. 154(b) by 105 days.

(21) Appl. No.: 09/833,393

(22) Filed: Apr. 12, 2001

(65) Prior Publication Data

US 2001/0033798 A1 Oct. 25, 2001

(30) Foreign Application Priority Data

Apr. 20, 2000 (JP) ..... 2000-119313

(51) Int. Cl.[7] ..... F04B 1/26

(52) U.S. Cl. ..... 417/222.2; 417/269; 92/71; 91/499; 91/505

(58) Field of Search ..... 417/222.2, 269; 92/71; 91/499, 505

(56) References Cited

U.S. PATENT DOCUMENTS 5,779,004 A * 7/1998 Hoshino et al. ..... 184/6.17
5,842,834 A 12/1998 Kawaguchi et al. ..... 417/222.2
6,224,348 B1 * 5/2001 Fukanuma et al. ..... 417/222.2
6,247,391 B1 * 6/2001 Murao et al. ..... 92/71
6,250,891 B1 * 6/2001 Kawaguchi et al. ..... 417/222.2
6,283,722 B1 * 9/2001 Takenaka et al. ..... 417/222.2
6,290,468 B1 * 9/2001 Kato et al. ..... 417/222.2
6,318,971 B1 * 11/2001 Ota et al. ..... 417/222.2
6,352,416 B1 * 3/2002 Ota et al. ..... 417/222.2

FOREIGN PATENT DOCUMENTS

JP A-6-74149 3/1994
JP A-6-299959 10/1994
JP A-8-312529 11/1996

* cited by examiner

*Primary Examiner*—Charles G. Freay
*Assistant Examiner*—William H. Rodriguez
(74) *Attorney, Agent, or Firm*—Woodcock Washburn LLP

(57) ABSTRACT

A lug plate 11 is secured to a drive shaft 7 which is rotatably supported in a housing so as to rotate together with the drive shaft, and a swash plate 12 is operatively connected to the lug plate through a hinge mechanism so as to rotate together with the lug plate and so as to vary an angle with respect to the drive shaft 7. Pistons 17 which are received in cylinder bores la so as to reciprocally move are operatively connected to the swash plate 12, so that not only can a refrigerant be introduced and discharged in accordance with the rotation of the drive shaft 7, but also the stroke of the pistons 17 can be varied by varying the angle of the swash plate 12. A front radial bearing 9B is provided on the outer periphery of a boss portion 11A of the lug plate 11 and a coil spring 16 to bias the swash plate 12 is received in a spring receiving portion 11C formed in the lug plate 11 on the rear side thereof.

7 Claims, 2 Drawing Sheets

COMPRESSOR

BACKGROUND OF THE INVENTION

1. Field of the Invention

The present invention relates to a compressor and, more precisely, it relates to a compressor in which the tilt angle of a cam plate is varied by a hinge mechanism to thereby vary the stroke of a piston.

2. Description of the Related Art

In a variable displacement compressor used in an air conditioner circuit for automobiles, a crank chamber is formed in a housing and a drive shaft which is rotatably supported in the crank chamber is driven by an engine to suck or discharge a refrigerant. In general, in this type of compressor, a cylinder block which constitutes a part of the housing is provided with a cylinder bore in which a piston is reciprocally moved. A lug plate, as a rotary support, is secured to the drive shaft so as to rotate with the shaft. A swash plate is operatively connected to the lug plate. The operative connection between the lug plate and the swash plate is such that the swash plate is rotatable together with the lug plate and can vary the angle defined between the swash plate and the drive shaft through a hinge mechanism. The piston is operatively connected to the outer peripheral portion of the swash plate, so that when the drive shaft is rotated, the reciprocal movement of the piston takes place to suck or discharge the refrigerant. Moreover, the angle of the swash plate with respect to the drive shaft can be varied by controlling the pressure in the crank chamber in order to vary the stroke of the piston.

In the conventional compressor mentioned above, since radial and thrust loads are exerted on the drive shaft, through the swash plate or the lug plate, it is necessary to provide bearings to receive the loads in the radial and axial directions. Moreover, due to a difference in pressure between the inside and the outside of the housing, it is necessary to provide a seal member in a gap between the housing and the drive shaft. Furthermore, it is necessary to provide a coil spring to continuously bias the swash plate in a direction to reduce the stroke of the piston. The coil spring is, in general, wound around the drive shaft between the swash plate and the lug plate.

The space for accommodating the bearings, the seal member, and the coil spring increases the overall length of the compressor and reduces the freedom of the arrangement thereof in a narrow engine compartment.

To eliminate these drawbacks, in a compressor disclosed in Japanese Kokai (Unexamined Patent Publication) No. 8-312529, the radial bearing which receives the load in the radial directions is provided between the lug plate secured to the drive shaft and the housing. The lug plate is provided, along the periphery of the drive shaft, with a recess in which the seal member is received, so that the seal member overlaps the bearing in the axial direction of the drive shaft.

In a compressor disclosed in Japanese Kokai No. 9-60587, the coil spring is received in the recess formed in the lug plate along the circumferential direction of the drive shaft, so that the coil spring can be moved to the front of the compressor.

However, in the compressor disclosed in Japanese Kokai No. 8-312529, the improvement is addressed only to the arrangement of the bearing and the seal member, and there is no specific reference in JPP '529 to a solution to the drawback of an increase in the overall length of the compressor due to the presence of the coil spring. In the compressor disclosed in Japanese Kokai No. 9-60587, the coil spring, the bearing, and the seal member are arranged on the drive shaft in line along the axis of the drive shaft. In this arrangement, if the depth of the recess in which the coil spring is received is increased in the forward direction of the compressor, the strength of the securing portion of the lug plate and the drive shaft tends to be insufficient and no reduction of the overall length of the compressor is considered in JPP '587.

SUMMARY OF THE INVENTION

It is an object of the present invention to provide a compressor in which not only can the overall length thereof be reduced (miniaturized) without reducing the strength of the rotary support but also the rigid connection between the rotary support and the drive shaft can be ensured.

To achieve the object mentioned above, according to the present invention, there is provided a compressor in which a drive shaft is rotatably supported in a housing which defines therein a crank chamber; a cylinder block which forms a part of the housing is provided with a cylinder bore; a piston is received in the cylinder bore so as to reciprocally move; a rotary support is secured to the drive shaft so as to rotate together therewith; a cam plate is operatively connected to the rotary support through a hinge mechanism which connects the cam plate to the rotary support so as to rotate together therewith and to vary an angle with respect to the drive shaft; said piston is operatively connected to the cam plate so that the rotation of the drive shaft causes the piston to reciprocally move to thereby suck and discharge a refrigerant and that the stroke of the piston can be varied by varying the angle of the cam plate with respect to the drive shaft, wherein a radial bearing is provided between the outer peripheral surface of a boss portion formed on the rotary support and the housing to support the drive shaft, and a coil spring is wound around the drive shaft between the cam plate and the rotary support to bias the cam plate in a direction to reduce the stroke of the piston, said coil spring being inserted in a spring receiving portion formed in the rotary support on the side thereof opposite the boss portion, the diameter of the outer periphery of the boss portion being greater than the diameter of the spring receiving portion.

With this structure, even if the radial bearing and the coil spring are located in close proximity in the axial direction of the drive shaft, since the radial bearing is provided on the outer periphery of the boss portion whose diameter is greater than the diameter of the spring receiving portion, a contact surface area necessary to fit and engage the rotary support to and with the drive shaft can be easily provided therebetween. Namely, it is easy to maintain the necessary strength for the fitting and engagement of the rotary support and the drive shaft. Moreover, it is possible to prevent the spring receiving portion from being too close to the outer periphery of the boss portion on which the radial bearing is provided, and hence the sufficient strength of the rotary support itself can be easily obtained. Consequently, the miniaturization of the compressor in the axial direction of the drive shaft (reduction of the overall length of the compressor) can be facilitated.

The present invention may be more fully understood from the description of preferred embodiments of the invention, as set forth below, together with the accompanying drawings.

DESCRIPTION OF THE PREFERRED EMBODIMENT

An embodiment of the present invention will be discussed below with reference to FIGS. 1 and 2.

Figure 1:
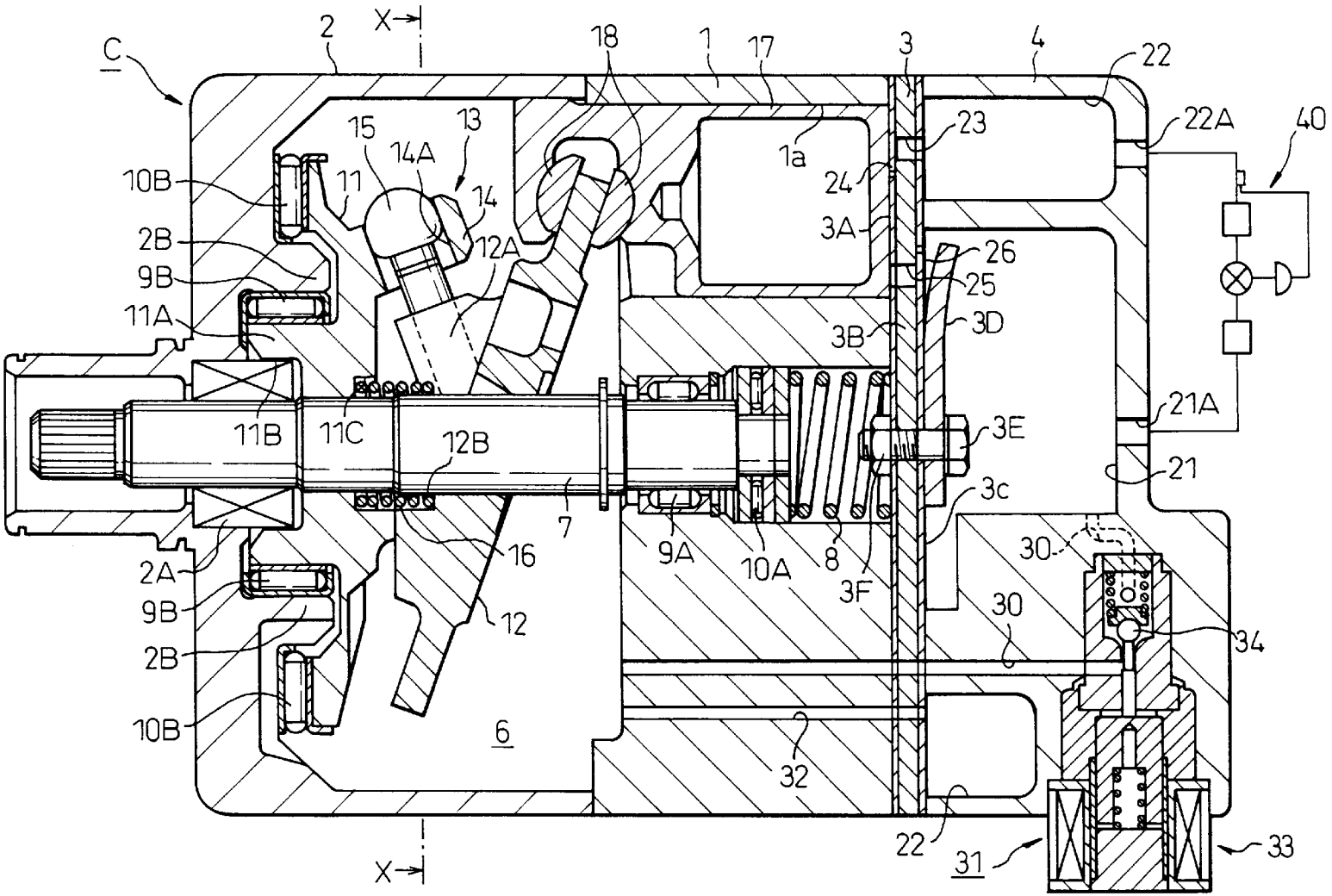
FIG. 1 is a schematic sectional view of a compressor according to an embodiment of the present invention.

A compressor C shown in FIG. 1 is comprised of a cylinder block 1, a front housing 2 secured to the front end of the cylinder block, and a rear housing 4 connected to the rear end of the cylinder block 1 through a valve forming body 3. The cylinder block 1, the front housing 2, the valve forming body 3 and the rear housing 4 are secured to each other by a plurality of through bolts (five bolts in the illustrated embodiment) 5 (not shown in FIG. 1 but shown in FIG. 2) to define a housing of the compressor C. A crank chamber 6 is defined in a space encompassed by the cylinder block 1 and the front housing 2. A drive shaft 7 is rotatably provided in the crank chamber 6. A spring 8, a rear radial bearing 9A and a rear thrust bearing 10A are arranged in a recess formed at the center of the cylinder block 1. A lug plate 11, as a rotary support, is fitted onto and secured to the drive shaft 7 so as to rotate therewith in the crank chamber 6. A front radial bearing 9B and a front thrust bearing 10B are arranged between the lug plate 11 and the inner wall of the front housing 2. The position of the drive shaft 7 and the lug plate 11 integral therewith in the thrust direction (axial direction of the drive shaft) is determined by the rear thrust bearing 10A biased by the spring 8 in the forward direction and the front thrust bearing 10B. A seal member 2A is provided between the inner wall of the front housing 2 and the drive shaft 7 to seal a gap therebetween.

The front end of the drive shaft 7 is operatively connected to a vehicle engine (not shown) as an external drive source) through a power transmission mechanism (not shown). The power transmission mechanism can be a clutch mechanism (electromagnetic clutch) which is driven in accordance with an external electrical control to transmit or interrupt the power, or a power transmission mechanism having no clutch, i.e., a permanent connection type power transmission mechanism (e.g., a combination of belt and pulley) which continuously transmits the power. In the illustrated embodiment, the permanent connection type power transmission mechanism is employed.

As can be seen in FIG. 1, a swash plate 12, as a cam plate, is arranged in the crank chamber 6. The swash plate 12 is provided on its center portion with a through hole, through which the drive shaft 7 extends. The swash plate 12 is operatively connected to the lug plate 11 and the drive shaft 7 through a hinge mechanism 13. The hinge mechanism 13 is composed of two support arms 14 (only one of which is shown) that project from the rear surface of the lug plate 11 and two guide pins 15 (only one of which is shown) that project from the front surface of the swash plate 11. The support arms 14 are each provided with a guide hole 14A which constitutes a guide portion, so that the guide pins 15 are inserted and engaged in the corresponding guide holes 14A. Due to the engagement of the support arms 14 and the guide pins 15 and the contact of the swash plate 12 with the drive shaft 7 in the central through hole of the swash plate, the swash plate 12 is rotatable synchronously with the lug plate 11 and the drive shaft 7 and is tiltable with respect to the drive shaft 7 while causing a sliding movement of the drive shaft 7 in the axial direction.

A coil spring 16 is wound around the drive shaft 7 between the lug plate 11 and the swash plate 12. The coil spring 16 biases the swash plate 12 in a direction to come close to the cylinder block 1, i.e., in a direction to decrease the tilt angle of the swash plate 12. Note that in the illustrated embodiment, the inclination angle (tilt angle) of the swash plate 12 is an angle defined between the swash plate 12 and a phantom plane normal to the axis of the drive shaft 7.

The cylinder block 1 is provided with a plurality of cylinder bores la (only one of which is shown in FIG. 1) surrounding the drive shaft 7. The rear ends of the cylinder bores la are closed by the valve forming body 3. A piston 17 with a head at its one end is fitted in each of the cylinder bores 1*a* so as to move reciprocally. Consequently, each cylinder bore la defines therein a compression chamber whose volume is varied in accordance with the reciprocal movement of the piston 17. Each piston 17 is engaged at its front end with the outer peripheral portion of the swash plate 12 through a pair of shoes 18, so that the pistons 17 are operatively connected to the swash plate 12. Consequently, when the rotation of the swash plate 12 synchronous with the drive shaft 7 occurs, the rotational movement of the swash plate 12 is converted to the reciprocal linear movement of the pistons 17 at the stroke corresponding to the tilt angle of the swash plate.

A central discharge chamber 21 and a suction chamber 22 surrounding the discharge chamber 21 are defined between the valve forming body 3 and the rear housing 4. The valve forming body 3 is comprised of a suction valve forming plate 3A, a port forming plate 3B, a discharge valve forming plate 3C and a retainer forming plate 3D, superimposed one on another. The forming plate elements of the valve forming body 3 are superimposed and connected to each other by a bolt 3E and a nut 3F. The valve forming body 3 is provided with a suction port 23 and a suction valve 24 which opens and closes the suction port 23, and a discharge port 25 and a discharge valve 26 which opens and closes the discharge port 25, for each cylinder bore 1*a*. The cylinder bores 1*a* are connected to the suction chamber 22 through the corresponding suction ports 23 and are connected to the discharge chamber 21 through the corresponding discharge ports 25.

The discharge chamber 21 is connected to the crank chamber 6 through a gas supply passage 30. The gas supply passage 30 is provided therein with a control valve 31. The suction chamber 22 is connected to the crank chamber 6 through a gas extraction passage 32. The control valve 31 is provided with a solenoid portion 33, and a valve body 34 which is operatively connected to the solenoid portion 33 through a rod. The solenoid portion 33 is driven by electricity supplied from a drive circuit (not shown), based on a signal from a controller computer, not shown, to vary the position of the valve body 34 to thereby control the opening area of the air supply passage 30. The control of the opening angle of the control valve 31 balances the quantity of the high-pressure gas to be introduced into the crank chamber 6 through the gas supply passage and the quantity of the gas to be discharged from the crank chamber 6 through the gas extraction passage 32 so as to determine the pressure Pc of the crank chamber.

The rear housing 4 is provided with a discharge passage 21A from which the refrigerant from the discharge chamber 21 is discharged and a suction passage 22A from which the refrigerant is introduced into the suction chamber 22. The discharge passage 21A and the suction passage 22A are connected by an external refrigerant circuit 40.

The front radial bearing 9B is provided between a cylindrical portion 2B of the front housing 2 protruding rearward from the inner wall thereof and the front and outer periphery of a boss portion 11A of the lug plate 11. Therefore, the front side of the drive shaft 7 is supported through the boss portion 11A of the lug plate 11 so as to rotate relative to the housing of the compressor C.

The boss portion 11A is provided on its front inner peripheral surface with a seal receiving portion 11B in which the seal member 2A is inserted and arranged in such a way that the seal member partly overlaps the front radial bearing 9B in the axial direction of the drive shaft 7. The seal receiving portion 11B is composed of a recess of a circular cross section, formed on the front end of the boss portion 11A, so that the seal member 2A, so that the seal member 2A can be inserted in an annular gap defined between the recess and the outer peripheral surface of the drive shaft 7. The lug plate 11 is provided, on its rear side away from the boss portion 11A, with a spring receiving portion 11C in which a part of a coil spring 16 is inserted. The spring receiving portion 11C is made of a recess of a circular cross section, so that the coil spring 16 is arranged in an annular space defined between the recess and the outer peripheral surface of the drive shaft 7. The outer diameter of the boss portion 11A is larger than the diameter of the seal receiving portion 11B and the diameter of the spring receiving portion 1C.

Figure 2:
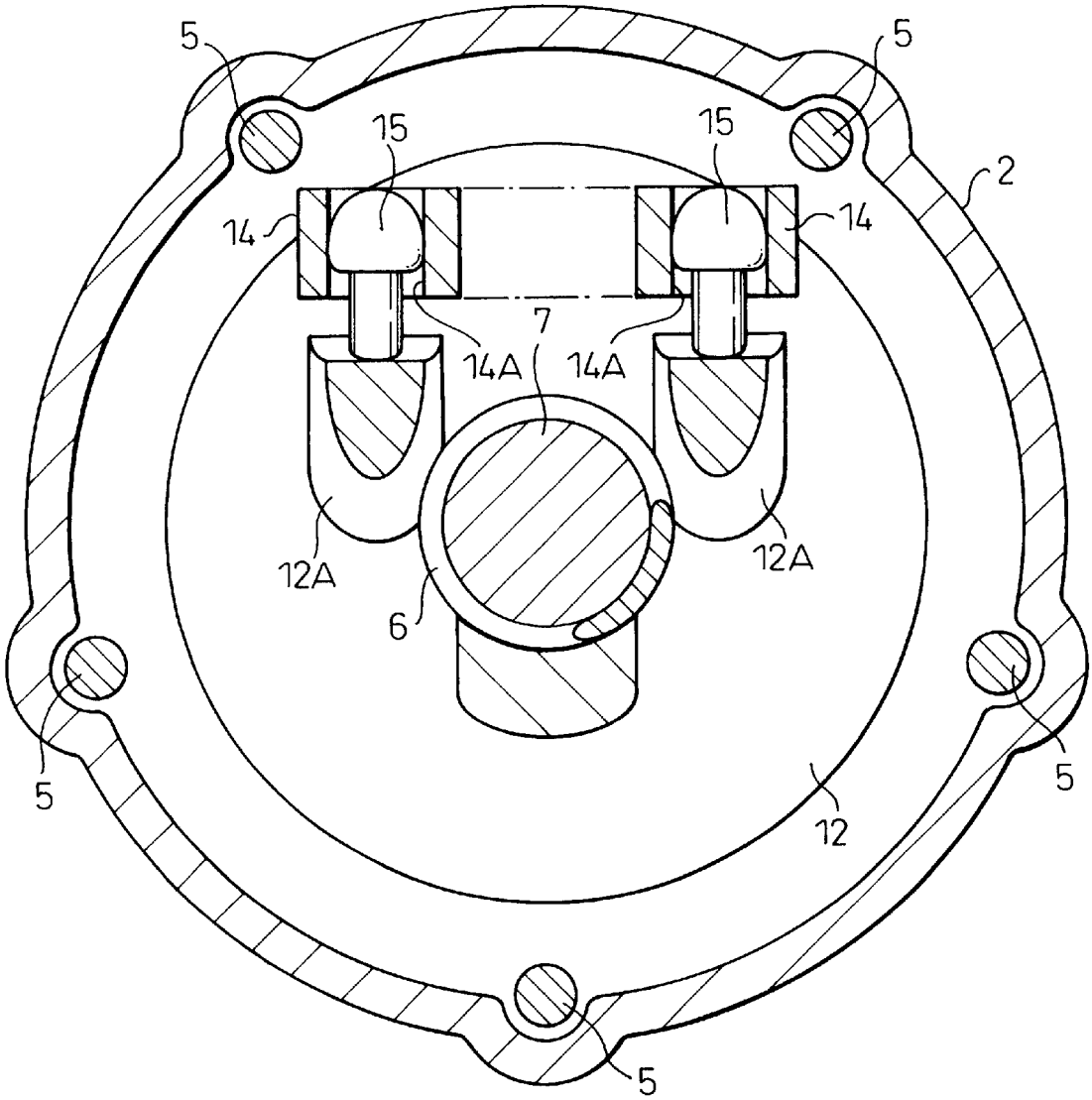
FIG. 2 is a sectional view taken along the line X—X in FIG. 1.

As can be seen in FIGS. 1 and 2, the swash plate 12 is provided on its front surface with two pin-support portions 12A. The guide pins 15 are press-fitted in corresponding recesses of the pin-support portions 12A. The coil spring 16 abuts against a spring seat 12B formed in the swash plate 12, to bias the swash plate 12 toward the cylinder block 1. The spring seat 12B is formed so that the coil spring 16 is located closer to the lug plate 11 than the guide pins 15. As shown in FIG. 2, the two pin-support portions 12A are located close to the drive shaft 7 so that the pin-support portions 12A partly overlap the coil spring 16 in the radial and axial directions of the drive shaft 7.

The operation of the compressor constructed as above will be discussed below.

When the power is transmitted from the vehicle engine to the drive shaft 7 through the power transmission mechanism, the swash plate 12 is rotated together with the drive shaft 7. The rotation of the swash plate 12 causes the pistons 17 to reciprocally move at a stroke corresponding to the tilt angle of the swash plate 12 to thereby sequentially and repeatedly carry out the suction, compression and exhaustion of the refrigerant in each cylinder bore la.

If the cooling load is heavy, the controller computer issues an instruction signal to increase the value of electric current to be supplied to the solenoid portion 33, to the drive circuit. In accordance with the change in the value of electric current from the drive circuit in response to the instruction signal, the solenoid portion 33 increases the biasing force to reduce the opening area of the supply passage 30 defined by the valve body 34. Consequently, the opening area of the gas supply passage 30 is increased owing to the movement of the valve body 34. Consequently, the quantity of the high pressure refrigerant gas supplied from the discharge chamber 21 to the crank chamber 6 through the gas supply passage 30 is reduced, and hence the pressure of the crank chamber 6 drops and the tilt angle of the swash plate 12 is increased to increase the discharge capacity of the compressor C. When the supply passage 30 is completely closed, a considerable pressure drop of the crank chamber 6 takes place and, accordingly, the tilt angle of the swash plate 12 becomes maximum, resulting in a maximum discharge capacity of the compressor C.

Conversely, if the cooling load is low, the solenoid portion 33 reduces the biasing force, so that the valve body 34 increases the opening area of the supply passage 34. Consequently, the pressure of the crank chamber 6 rises as a result of the movement of the valve body 34. Due to the rise of the pressure of the crank chamber as well as the biasing force of the coil spring 16, the tilt angle of the swash plate 12 is reduced and the discharge capacity of the compressor C is reduced. When the supply passage 30 is fully open, considerable pressure rise of the crank chamber 6 occurs and the tilt angle of the swash plate 12 becomes minimum, thus resulting in the smallest discharge capacity of the compressor C.

The following advantages can be expected from the illustrated embodiment.

(1) The front radial bearing 9B is provided on the outer peripheral surface of the boss portion 11A of the lug plate 11 on the front side thereof, and the coil spring 16 is inserted in the spring receiving portion 11C formed in the lug plate 11 on the rear side thereof. The diameter of the outer peripheral portion of the boss portion 11A on which the front radial bearing 9B is provided is greater than the diameter of the spring receiving portion 1C. Consequently, if the front radial bearing 9B and the coil spring 16 are located close to each other in the axial direction of the drive shaft 7, it is possible to provide a contact surface large enough to establish rigid fitting and connection between the lug plate 11 and the drive shaft 7, without difficulty. Namely, it is possible to maintain the strength of the connection between the lug plate 11 and the drive shaft 7, at a necessary value. Moreover, since it is possible to prevent the outer peripheral portion of the boss portion 11A on which the front radial bearing 9B is provided from being too close to the spring receiving portion 11C, it is possible to maintain the strength of the lug plate 11 itself. Consequently, the compressor C can be easily made small (short in the axial length).

(2) The coil spring 16 abuts against the spring seat 12B to bias the swash plate 12 in the direction toward the cylinder block 1, and the spring seat 12B is formed so that the coil spring 16 is located closer to the lug plate 11 than the guide pins 15. Namely, the coil spring 16 and the guide pins 15 do not overlap in the axial direction of the drive shaft 7. Consequently, if the guide pins 15 are moved in the radial direction of the drive shaft 7 and is located close to the drive shaft 7, no interference with a space for accommodating the coil spring 16 occurs. Furthermore, the movement of the guide pins does not affect the biasing operation of the coil spring 16. Namely, the guide pins 15 can be easily arranged in close proximity to the drive shaft 7. Thus, the miniaturization of the swash plate 12 can be easily realized owing to the close arrangement.

(3) The seal receiving portion 11B is provided on the inner peripheral surface of the boss portion 11A provided on its outer periphery with the front radial bearing 9B. The seal member 2B is arranged in the seal receiving portion 11B so that the seal member 2A overlaps the front radial bearing 9B in the axial direction of the drive shaft 7. Consequently, the miniaturization of the compressor C (reduction of the overall length of the compressor) in the axial direction of the drive shaft 7 can be facilitated.

(4) Since the inner diameter of the front radial bearing 9B is greater than the outer diameter of the seal member 2A, it is possible to insert the seal member 2A in the inner periphery of the front radial bearing 9B after the front radial bearing 9B is fitted in the cylindrical portion 2B of the front housing 2, thus resulting in an enhanced assembling efficiency.

(5) The front radial bearing 9B is provided on the outer peripheral surface of the boss portion 11A whose diameter is greater than the drive shaft 7. Namely, the front radial bearing 9B is larger in diameter than the bearing provided directly on the drive shaft 7. That is, in comparison with an arrangement in which the front radial bearing 9B was provided directly on the drive shaft 7, the bearable load capacity in the radial direction, acting on the drive shaft 7 can be increased. Therefore, if no increase in the load capacity is needed, the axial length of the front radial bearing 9B can be shortened. As a result, the compressor C can be made smaller.

The present invention is not limited to the illustrated embodiment and can be modified, for example, as follows.

It is possible to arrange the spring receiving portion 12B of the swash plate 12 in such a way that the coil spring 16 overlaps the guide pins 15 in the axial direction of the drive shaft 7. In this arrangement, it is possible to make the compressor C smaller in the axial direction.

It is possible to provide the seal member 2A on the front side of the lug plate 11 so as not to overlap the front radial bearing 9B in the axial direction of the drive shaft 7, without providing the seal member 11B on the lug plate 11.

The lug plate 11 may be cast. It is possible to fit a bush which functions as an inner race of the front radial bearing 9B, onto the outer periphery of the boss portion 11A. In this arrangement, it is possible to decrease the number of the portions of the lug plate 11 to be machined, thus resulting in reduction of the manufacturing cost.

The inner diameter of the front radial bearing 9B may be greater than the outer diameter of the seal member 2A.

Although the guide pins 15 are press-fitted and secured in the pin support portions 12A in the illustrated embodiment, it is possible to secure the guide pins by welding or screws, etc., other than press-fitting.

The guide pins 15 and the pin support portions 12A may be formed integral with the swash plate 12 without making them of separate pieces.

The hinge mechanism 13 can be comprised of a first arm provided on the swash plate 12, a second arm provided on the second arm, a guide hole formed on one of the first and second arms, a mounting hole formed on the other arm, and a pin which extends through the mounting hole and which is provided with a projecting portion inserted in the guide hole.

As can be understood from the above discussion, according to the present invention, it is possible not only to reduce (miniaturize) the overall length of the compressor in the axial direction, but also to maintain the strength of the rotary support and the rigid connection between the rotary support and the drive shaft.

While the invention has been described by reference to specific embodiments chosen for purposes of illustration, it should be apparent that numerous modifications could be made thereto, by those skilled in the art, without departing from the basic concept and scope of the invention.

What is claimed is:

1. A compressor in which a drive shaft is rotatably supported in a housing which defines therein a crank chamber; a cylinder block which forms a part of the housing is provided with a cylinder bore; a piston is accommodated in the cylinder bore so as to reciprocally move; a rotary support is secured to the drive shaft so as to rotate together therewith; a cam plate is connected to the rotary support through a hinge mechanism so as to rotate together therewith and to vary an angle with respect to the drive shaft; said piston is connected to the cam plate so that the rotation of the drive shaft causes the piston to reciprocally move to thereby suck and discharge a refrigerant and that the stroke of the piston can be varied by varying the angle of the cam plate with respect to the drive shaft, wherein a radial bearing is provided between the outer peripheral surface of a boss portion formed on the rotary support and the housing to support the drive shaft, a coil spring is wound around the drive shaft between the cam plate and the rotary support to bias the cam plate in a direction to reduce the stroke of the piston, said coil spring being inserted in a spring receiving portion formed in the rotary support on the side thereof opposite the boss portion, the diameter of the outer periphery of the boss portion is greater than the diameter of the spring receiving portion.

2. A compressor according to claim 1, wherein said hinge mechanism connects the cam plate and the rotary support by an engagement of a pin press-fitted in the cam plate with a guide portion formed in a support arm that projects from the rotary support toward the cam plate, said coil spring being located closer to the rotary support than the pin.

3. A compressor according to claim 1, wherein said rotary support is cast and a bush which serves as an inner race of the radial bearing is fitted onto the outer peripheral surface of the boss portion.

4. A compressor according to claim 1, wherein a seal member is provided in a seal receiving portion formed in the boss portion to seal a gap between the housing and the drive shaft, the diameter of the seal receiving portion being smaller than the diameter of the outer periphery of the boss portion.

5. A compressor according to claim 2, wherein a seal member is provided in a seal receiving portion formed in the boss portion to seal a gap between the housing and the drive shaft, the diameter of the seal receiving portion being smaller than the diameter of the outer periphery of the boss portion.

6. A compressor according to claim 4, wherein the inner diameter of the radial bearing is greater than the outer diameter of the seal member.

7. A compressor according to claim 5, wherein the inner diameter of the radial bearing is greater than the outer diameter of the seal member.

* * * * *